United States Patent [19]

Cerliani

[11] 4,157,691

[45] Jun. 12, 1979

[54] SPOOL CASE FOR SEWING MACHINES

[75] Inventor: Alberto Cerliani, Pavia, Italy

[73] Assignee: Costruzioni Meccaniche Cerliani S.p.A., Pavia, Italy

[21] Appl. No.: 886,082

[22] Filed: Mar. 13, 1978

[30] Foreign Application Priority Data

Jul. 13, 1977 [IT] Italy ..... 25693 A/77

[51] Int. Cl.[2] ..... D05B 57/26

[52] U.S. Cl. ..... 112/229

[58] Field of Search ..... 112/229, 231

[56] References Cited

U.S. PATENT DOCUMENTS

| | | | |
|---|---|---|---|
| 2,244,876 | 6/1941 | Frampton | 112/231 X |
| 2,555,658 | 6/1951 | Ritter | 112/229 |
| 3,096,736 | 7/1963 | Johnson | 112/231 X |
| 3,568,616 | 3/1971 | Coulombe | 112/229 |

FOREIGN PATENT DOCUMENTS

| | | | |
|---|---|---|---|
| 2454121 | 6/1975 | Fed. Rep. of Germany | 112/229 |
| 1200989 | 8/1970 | United Kingdom | 112/231 |

*Primary Examiner*—Wm. Carter Reynolds

[57] ABSTRACT

Spool case for sewing machines having devices for adjusting the braking spring of the thread spool. The case comprises a front wall and a cylindrical skirt portion defining a cavity or recess accommodating a thread spool; a flat spring for spool braking is secured internally on the front wall of the case and a screw acts upon the spring to adjust the braking pressure thereof. Between its securing location to the case and its contact location with the pressure adjusting screw, said braking spring has a projection or lug engaging with the case skirt.

4 Claims, 4 Drawing Figures

SPOOL CASE FOR SEWING MACHINES

This invention relates to a stitch-forming mechanism for sewing machines comprising a spool case provided with means for braking the rotation of the lower thread spool in a double knotted stitch type of sewing machine, avoiding an undue overrunning of the spool and accordingly an undue thread unwinding during stitching process.

At present, in spool cases of the above mentioned design, it is known to use a flat spring, which is secured internally and on the front wall of the case, and acts against a spool flange to brake or restrain the rotation of said spool. In order to adjust the amount of friction exerted by the braking spring on the spool, it is also known to use an adjusting screw which is screwed down in a threaded hole in the case front wall and is effective at an intermediate location of the spring to increase or reduce, respectively, the pressure of the latter on the spool, as required.

Braking springs at present used substantially comprise a segment of metal strip having a straight length and a subsequent arcuate length following the inner cylindrical contour of the case skirt portion and which is resiliently pressed against the spool flange. Although this type of spring affords some degree of adjustment for the spool braking pressure, there is a substantial tendency of the spring, as biased by the rotating spool, to twist only partly adhering with its edge to the spool flange, and as a result the braking pressure would change during operation, thereby providing a poor braking effect.

The present invention is directed to a spool case of the above specified design, wherein the braking spring is provided with means for avoiding any twisting thereof and enabling to maintain the braking action exerted on the thread spool at a substantially constant degree.

Generally, according to the invention, a spool carrier case for stitch-forming mechanism of sewing machines is provided, which comprises: a case having a front wall and a peripheral skirt-portion defining a cavity or recess accommodating a thread spool; a spool braking flat spring secured internally and on said front wall; an adjusting screw acting upon said spring to adjust the spool braking pressure, in which between its fastening location to the case and its contacting location with the pressure adjusting screw, said braking spring has a side projection or lug engaging the skirt-portion of the case to avoid any twisting of the spring when the latter is biased by the rotating thread spool.

These and further features of a spool case according to the present invention will be hereinafter more clearly disclosed with reference to the accompanying drawings, in which.

Figure 1:
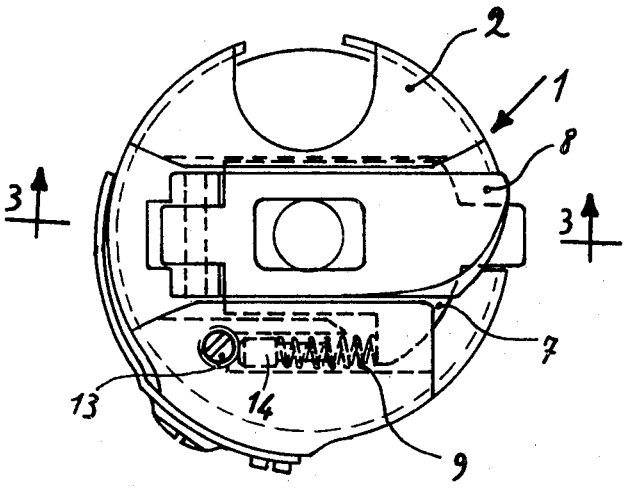
FIG. 1 is a plan view of a case according to the invention.

Referring to the figures of the accompanying drawings, it will be seen that cup-like spool case 1 substantially comprises a front wall 2 provided with a thin cylindrical skirt portion 3 defining a cavity or recess accommodating a spool 4, having a predetermined amount of thread wound up thereon. The spool 4 is inserted and held at a centered position by a hollow central hub 5 inwardly projecting from said front wall 2 of the case, whereas a locking pin 6, in a per se known manner and hatched in FIG. 4, passes therethrough. Case 1 is further completed by a latch 7 operable by a lever 8 and under the action of a return spring 9 to engage said pin.

Figure 2:
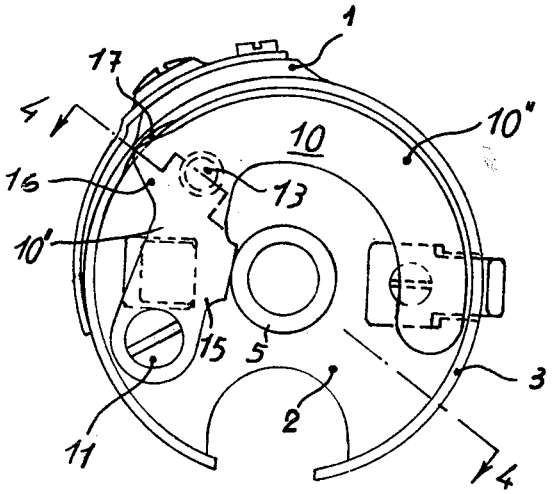
FIG. 2 is a rear view of an empty case.
Figure 3:
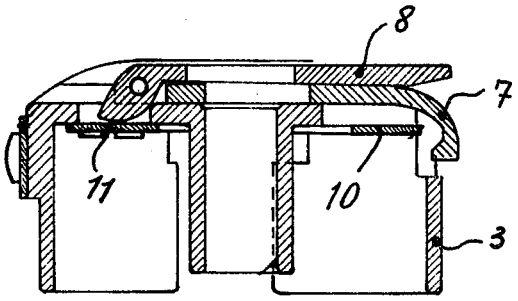
FIG. 3 is a cross-sectional view taken along line 3—3 of FIG. 1.
Figure 4:
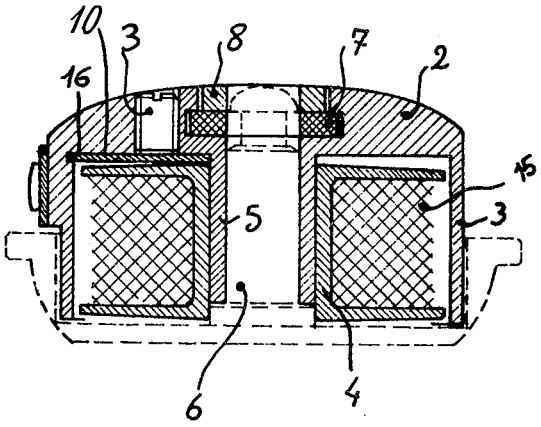
FIG. 4 is a cross-sectional view taken along line 4—4 of FIG. 2.

As depicted in FIG. 2 and shown in the sectional views of FIGS. 3 and 4, a flat spring 10 is secured internally as will be described more fully subsequent hereto and on the front wall 2, which spring is effective by exerting a pressure against a flange of spool 4 for a braking effect on the latter.

Spring 10 substantially is of a sickle configuration and has a straight length 10′ for fixing to said front wall 2 by a screw 11 passing through a hole in said spring length 10′ and screwing down in a corresponding threaded hole in said wall 2. Spring 10 further comprises a second arcuate length 10″ following the inner contour of skirt-portion 3 and bearing on the inner flange of spool 4 to exert said braking effect. The friction of braking spring 10 on the flange of spool 4 can be adjusted in a per se known manner, such as by an adjusting screw 13 which from outside is screwed down in a threaded hole in the front wall 2 and which is effective on spring 10 remote from securing screw 11, for example at the transition point between said straight length 10′ and arcuate length 10″ of the spring. In order to prevent loosening of said adjusting screw 13, a friction element may be optionally provided, which friction element is in the form of a plunger 14 or other equivalent means, tangentially acting on adjusting screw 13 and which is urged to adhere, for example, by said latch return spring 9.

From FIG. 2 it will be seen that a first side projection or lug 15, formed on the inner edge of the spring, acts against said hollow hub 5 to maintain spring 10 at a centered position and prevent the latter from being angularly displaced under the dragging action of spool 4. Still from FIG. 4, it will also be noted that spring 10 has on its outer edge a second projection or lug 16 engaging the inner surface of skirt 3. Particularly, from the view of FIG. 2 and section of FIG. 4, it will be seen that said outer spring projection or lug 16 engages in a notch 17 formed in skirt portion 3, penetrating for a very short distance therein, as shown.

In the example shown, said projection or lug 16 is provided at the transition between said straight length 10′ and arcuate length 10″ of flat spring 10, and more particularly at the contact location of said screw 13 for adjusting the braking pressure. However, as apparent, said projection or lug 16 could be differently formed and at any other location intermediate spring securing point 11 and contact point 13 for said braking pressure adjusting screw. As above referred to, said projection or lug 16 engaging the cylindrical skirt 3 of the case, accomplishes the function of providing an additional restraint at an intermediate location of the spring to prevent the arcuate length 10″ of said spring from being twisted under the bias of rotating spool 4, thereby allowing to maintain a constant braking pressure on the spool.

What is claimed is:

1. A spool case for a stitch-forming mechanism for a sewing machine comprising a case having a front wall a central hub and a cylindrical skirt portion defining a cavity or recess accommodating a thread spool, a flat spring secured internally on said front wall by a securing screw, an adjusting screw acting on said flat spring adjusting a braking pressure on said spool, said flat spring having a first projection or lug engaging said skirt portion of said case at a point intermediate the adjusting screw and the securing screw and said flat spring having a second projection or lug engaging said central hub.

2. A case according to claim 1, wherein said first projection or lug is formed laterally on an outer edge of the flat spring.

3. A case according to claim 1, wherein said first projection or lug engages in a notch formed in the skirt portion.

4. A case according to preceding claim 1, wherein said first projection or lug is formed adjacent the adjusting screw.

* * * * *